United States Patent [19]

Broughton

[11] Patent Number: 5,031,813

[45] Date of Patent: Jul. 16, 1991

[54] DISPENSING CONTAINER HAVING A TEAR STRIP WITH END TABS

[75] Inventor: David N. Broughton, Greenwood, Ind.

[73] Assignee: Dow Brands, Inc., Indianapolis, Ind.

[21] Appl. No.: 531,956

[22] Filed: Jun. 1, 1990

[51] Int. Cl.[5] ..... B26F 3/02

[52] U.S. Cl. ..... 225/49; 225/19

[58] Field of Search ..... 225/50, 19, 48, 49

[56] References Cited

U.S. PATENT DOCUMENTS

| | | | |
|---|---|---|---|
| 2,472,521 | 6/1949 | Danenbauer | 225/50 |
| 3,777,957 | 12/1973 | Buttery | 225/50 |
| 3,974,947 | 8/1976 | Budny | 225/25 |
| 4,899,918 | 2/1990 | Oketani et al. | 225/43 |

*Primary Examiner*—Mark Rosenbaum

*Assistant Examiner*—John M. Husar

[57] ABSTRACT

Disclosed is a dispensing container for sheet-like material in roll form wherein the container has a tear strip having end tab portions which facilitate easy and safe removal of the strip.

4 Claims, 1 Drawing Sheet

DISPENSING CONTAINER HAVING A TEAR STRIP WITH END TABS

BACKGROUND

A problem associated with prior art dispensing containers for flexible sheet-like materials supplied in roll form is the removal of the tear strip. Tear strips are provided in dispensing containers to protect consumers from the exposed edge of the cutter bar during attendant handling of the container prior to opening of the same. Tear strips are typically adhered with glue to the front of the container in proximity to the exposed edge of the cutter bar. Removing the adhered tear strip may require that the consumer to run his or her fingers underneath either or both ends of the tear strip to separate it from the front of the container. The running of fingers underneath the tear strip in proximity to the exposed edge of the cutter bar may expose the consumer to risk of injury.

Accordingly, there is a need for a dispensing container having a hand-peelable tear strip which minimizes exposure of the consumer to the exposed edge of the cutter bar. Further accordingly, there is a need for a dispensing container having a hand-peelable tear strip which the tearing motion is easily intitiated at either end of the strip.

SUMMARY OF THE INVENTION

According to the present invention, there is a dispensing container for flexible sheet-like materials supplied in roll form wherein the dispensing container comprises a hollow, generally rectangular box. The box has a lid, a front panel, and a cutter bar. The lid has a front flange having a tear strip detachable along a weakened line. The tear strip and the cutter bar generally extending from one end of the container to the other. The cutter bar has an exposed cutting edge. The tear strip is situated to cover the extension of the front portion of the exposed edge. The tear strip has end tab portions detachable therefrom along weakened lines.

BRIEF DESCRIPTION OF THE DRAWINGS

The novel features of the present invention and the context within which they are set will be better understood upon reviewing the following specification together with the several drawings in which the same reference numbers are employed for the same parts in the various views and wherein.

DETAILED DESCRIPTION OF THE INVENTION

Figure 1:
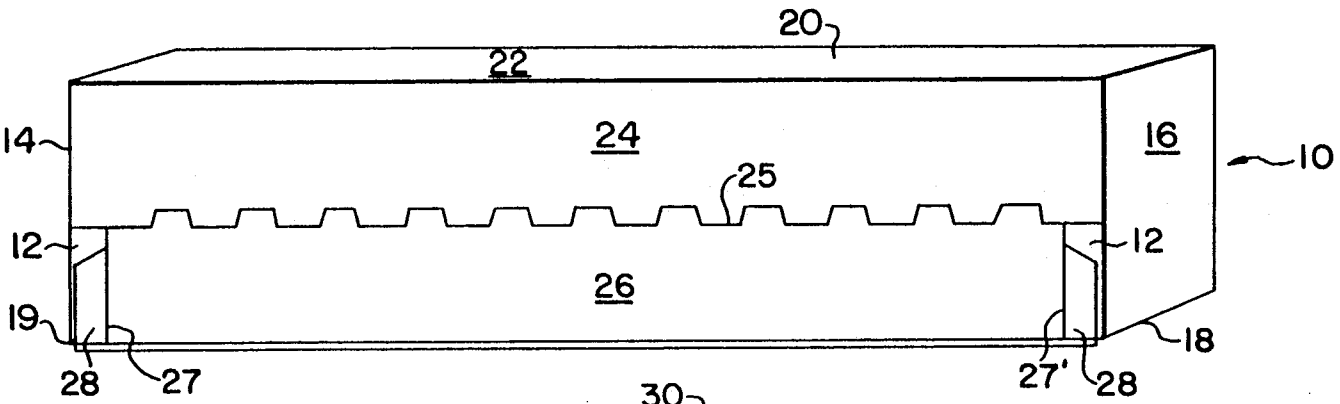
FIG. 1 is a front oblique view of an embodiment of a dispensing container of the present invention.
Figure 2:
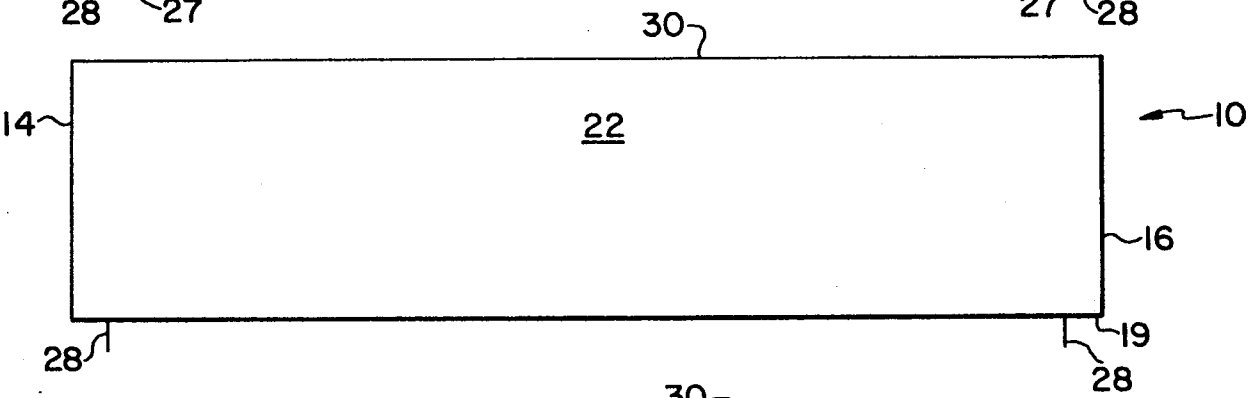
FIG. 2 is a top view of the container of FIG. 1 wherein end tab portions of a tear strip are engaged in an outward position suitable for grasping by hand to remove the tear strip from the container.
Figure 3:
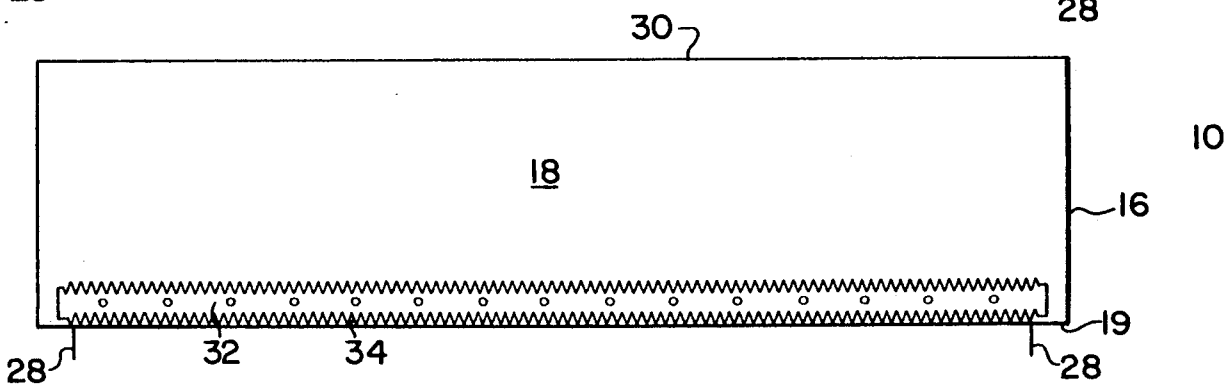
FIG. 3 is a bottom view of the container of FIG. 1 wherein end tab portions of a tear strip are engaged in an outward position suitable for grasping by hand to remove the tear strip from the container.

Referring to FIGS. 1, 2, and 3, a dispensing container constructed in accordance with the present invention for film, paper, foil, or other sheet-like materials supplied in roll form is generally designated by reference numeral 10.

Container 10 of FIG. 1 forms a generally hollow, rectangular box, and is primarily composed of a plurality of panels foldably connected. The rectangular portion of container 10 comprises a bottom panel 18, a back panel 30, a front panel 12, first and second end panels 14 and 16, a front panel-bottom panel interface 19, and a lid 20. Lid 20 comprises a top panel 22 and a front flange 24. Container 10 also comprises a cutter bar 32, which generally extends from one end of container 10 to the other.

Front flange 24 may have a tear strip 26 which is detachable along a weakened line 25 and generally extends from one end of the container to the other. A first weakened line 25 may take the form of folds, grooves, scores, serrations, or perforations within flange 24. Line 25 is strong enough to withstand normal attendant handling of container 10 yet weak enough that tear strip 26 may be separated from flange 24 by hand.

Front panel 12 horizontally extends from one end of container 10 to the other, and may vertically extend from the lowest portion to the uppermost portion of the front portion of container 10. Preferably, front panel 12 vertically extends from the lowest portions to a height of between one-third and two-thirds of the height of the front portion of container 10. Preferably, container 10 will define a slit-like aperture (not shown) generally extending from one end of the container to the other between front flange 24 and front panel 12 when tear strip 26 is detached from the remainder of flange 24 and when lid 20 is in closed position. Sheet-like material (not shown) may be drawn from container 10 through the slit-like aperature.

Cutter bar 32 may be comprised of metal, plastic, or cardboard, and defines an exposed edge 34 which may be straight, serrated, or grooved. Bar 32 is preferably mounted flush to the outer surface of bottom panel 18 and positioned so that the edge 34 is exposed at the front panel-bottom panel interface as seen in FIG. 3. Preferably, edge 34 has a grooved edge. The sheet-like material may be drawn across edge 34, and severed along a generally straight line in a pattern similar to that of edge 34. When tear strip 26 is detached from the remainder of flange 24 and front panel 12, edge 34 is exposed.

Tear strip 26 is adhered to the outer surface of front panel 12 along substantially the length of its inner surface by glue means (not shown) situated between strip 26 and panel 12. Preferably, the glue means is situated on the outer surface of panel 12. Preferably, end tab portions 28 are not adhered to panel 12 so that portions 28 may be easily grasped and manipulated to an outward position not planar with tear strip 26 as seen in FIGS. 2 and 3.

Tear strip 26 defines end tab portions 28 connected therewith along second and third weakened lines 27 and 27', respectively. End tab portions 28 are connected to the remainder of strip 26 along weakened lines 27 and 27'. Weakened lines 27 act like hinges so that portions 28 may be biased outwardly by hand manipulation. Portions 28 may then be easily grasped to facilitate removal of tear strip 26 from the remainder of flange 24 and front panel 12. Weakened lines 27 and 27' may take the form of folds, grooves, scores, serrations, or perforations within strip 26. Lines 27 and 27' are weak to an extent that they allow portions 28 to be biased to an outward position yet strong enough that the remainder of tear strip 26 may be removed from the remainder of flange 24 and panel 12 without portions 28 becoming separated from the remainder of tear strip 26 along lines 27 and 27'.

An embodiment of the invention has been shown with regard to specific details in designs for a dispensing container having a tear strip. It will be appreciated that depending upon the dispensing container and the manufacturers' desires, the invention may be modified by various changes while still being fairly within the scope of the general teachings and principles hereof.

What is claimed is:

1. A dispensing container for flexible sheet-like materials supplied in roll form, the dispensing container comprising a hollow, generally rectangular box, wherein the box has a lid, a front panel, a bottom panel, a front-bottom panel interface, and a cutter bar, the lid having a front flange, the front flange having a tear strip detachable along a first weakened line, the tear strip and the cutter bar generally extending from one end of the container to the other, the cutter bar having an exposed cutting edge, the tear strip being situated to cover the exposed edge, the tear strip having opposite end tab portions, each end tab portion hingedly connected to the tear strip along a second and a third weakened line, respectively, permitting biasing of each tab portion outwardly by hand manipulation without the tab portions being detachable from the tear strip along the second and the third weakened lines.

2. The container of claim 1, wherein the second and the third weakened lines take the form of scorings within the front flange and the tear strip.

3. The container of claim 1, wherein the tear strip is adhered to the front panel by glue means situated therebetween along substantially the length of the front panel with the tab portions being unadhered to the front panel for easy grasp and manipulation to an outward position not planar with the tear strip.

4. The container of claim 1, wherein the cutter bar is mounted on the bottom panel with the exposed edge of the cutter bar being located at the front panel-bottom panel interface.

* * * * *